US012618635B1

(12) United States Patent
Casey et al.

(10) Patent No.: US 12,618,635 B1
(45) Date of Patent: May 5, 2026

(54) WEAPON EMULATOR SIMULATING A MUZZLE FLASH

(71) Applicant: Obsidian Dynamics, LLC, Burbank, CA (US)

(72) Inventors: Mike Casey, Solvang, CA (US); Thomas Melton, Thousand Oaks, CA (US)

(73) Assignee: OBSIDIAN DYNAMICS, LLC, Burbank, CA (US)

( * ) Notice: Subject to any disclaimer, the term of this patent is extended or adjusted under 35 U.S.C. 154(b) by 0 days.

(21) Appl. No.: 19/047,051

(22) Filed: Feb. 6, 2025

(51) Int. Cl.
*F41A 33/02* (2006.01)
*F41A 33/06* (2006.01)

(52) U.S. Cl.
CPC ..... *F41A 33/02* (2013.01); *F41A 33/06* (2013.01)

(58) Field of Classification Search
CPC ..... F41A 33/02; F41A 33/06; A63H 33/009
See application file for complete search history.

(56) References Cited

U.S. PATENT DOCUMENTS

| | | | | |
|---|---|---|---|---|
| 2,294,558 | A | 9/1942 | Hooker et al. | |
| 2,648,159 | A * | 8/1953 | Rotfeld | A63H 5/04 362/112 |
| 5,947,738 | A * | 9/1999 | Muehle | F41A 33/02 434/18 |
| 6,146,141 | A * | 11/2000 | Schumann | F41A 33/06 434/21 |
| 7,726,293 | B2 | 6/2010 | Wei | |
| 7,927,102 | B2 | 4/2011 | Jones et al. | |
| 8,602,784 | B2 | 12/2013 | Dvorak | |
| 9,759,521 | B2 | 9/2017 | Carriere | |
| 9,810,502 | B2 | 11/2017 | Monti et al. | |
| 9,952,016 | B2 | 4/2018 | Sullivan | |
| 10,036,608 | B2 | 7/2018 | Hunt | |

(Continued)

FOREIGN PATENT DOCUMENTS

| | | | |
|---|---|---|---|
| DE | 202015001994 | U1 | 6/2015 |
| EP | 3766768 | B1 | 1/2021 |

OTHER PUBLICATIONS

Steve Wyness, Make an Alien Rifle Prop With Flash Effect, Retrieved From: https://makezine.com/projects/make-an-alien-rifle-prop-with-flash-effect/, Oct. 16, 2013, Magazine.

(Continued)

*Primary Examiner* — Christopher E Dunay
(74) *Attorney, Agent, or Firm* — Vorys, Sater, Seymour and Pease LLP; Michael Messinger

(57) ABSTRACT

A weapon emulator has a muzzle flash emulator attachment coupled to a first end of a barrel. The muzzle flash emulator attachment includes: a body defining a plurality of slots, a cover disposed in the body, a light source at least partially disposed in the cover, and a circuit coupled to the light source and including a power source and a switch. The switch is transitionable from an open state to a closed state to turn on the light source in response to pulling a trigger. In another embodiment, a muzzle flash emulator assembly includes a magnet operatively aligned with a reed switch. In a further embodiment, a muzzle flash emulator has a member coupled to a barrel and moveable to strike the switch in response to pulling the trigger to transition the switch from the open state to the closed state.

15 Claims, 9 Drawing Sheets

(56) References Cited

U.S. PATENT DOCUMENTS

| | | | | |
|---|---|---|---|---|
| 10,132,472 | B2 | 11/2018 | Joseph | |
| 11,313,638 | B2 | 4/2022 | Dottle | |
| 2004/0087377 | A1* | 5/2004 | Liu | F41A 33/02 463/51 |
| 2008/0187888 | A1* | 8/2008 | Jones | F41A 33/02 434/21 |
| 2012/0129136 | A1* | 5/2012 | Dvorak | F41A 33/06 434/18 |
| 2014/0065577 | A1* | 3/2014 | Quinlan | F41A 33/06 434/18 |
| 2014/0272806 | A1 | 9/2014 | Hunt | |
| 2015/0103510 | A1 | 4/2015 | Reetz et al. | |
| 2018/0058799 | A1* | 3/2018 | Kawawaki | F42B 12/42 |
| 2018/0306548 | A1 | 10/2018 | Hunt | |
| 2021/0356228 | A1 | 11/2021 | Chang | |
| 2022/0099404 | A1 | 3/2022 | Sullivan | |

OTHER PUBLICATIONS

Movie Props: Fake Muzzle Flash, , Scott Prop and Roll, Retrieved From YouTube: https://www.youtube.com/watch?v=XRz-C3Mnf_k, Jun. 1, 2024.

* cited by examiner

WEAPON EMULATOR SIMULATING A MUZZLE FLASH

FIELD OF THE DISCLOSURE

The present disclosure relates generally to a weapon emulator and, more particularly, to prop firearms used during filming.

BACKGROUND OF THE DISCLOSURE

Real firearms that are modified to use blanks have often been used as props to film modern movies (or TV shows, videos, or the like) to attain the realism that audiences demand. Using real firearms to film, however, present several safety, legal, and cost concerns to the person or persons producing and directing the movie.

Blanks can be relatively safe from as close as three feet away but are potentially dangerous or lethal up close or if fired while pressed against an object. There is the potential for the wrong type of blank to be loaded into the firearm which can lead to a misfire that can cause serious injury. The combustion of the gunpowder in the blank heats up the gun which can cause burns. Additionally, there is also the potential for accidental discharges of the blanks on set due to inadvertent pulling of the trigger which poses a danger to personnel. These physical dangers can lead to lawsuits. Using real guns and blanks also subjects the production to the jurisdiction of the Bureau of Alcohol, Tobacco and Firearms (BATF) which regulates firearm use. These regulations increase costs and can cause delays in the production. In addition to increased regulatory scrutiny, using real guns increases production costs due to the use of consumables (i.e. blanks, squibs, etc.) during production. Using real guns also increases the cost of insurance premiums and requires hiring and maintaining a staff of trained personnel to manage the firearms on set as well as security personnel to secure the transportation and storage of the firearms.

Blanks also present practical issues in addition to the danger, legal, and cost concerns. For example, guns modified to use blanks can misfire or jam which can result in the need for multiple "takes" due to technical difficulties with a prop. Additionally, using blanks may necessitate car protection that must be edited out during post-production or be subject the production to noise regulations of the locality where the scene is being filmed.

Therefore, there is a need in the art for a prop firearm (e.g., weapon emulator) that can simulate a muzzle flash and realistic operation of the firearm while omitting the use of blanks.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

In one embodiment, a weapon emulator has a frame, a trigger and a barrel coupled to the frame, a power source coupled to the frame, and a muzzle flash emulator attachment coupled to a first end of the barrel. The muzzle flash emulator attachment includes: a body defining a plurality of slots, a cover disposed in the body, a light source at least partially disposed in the cover, and a circuit coupled to the light source and including a power source and a switch. The switch is transitionable from an open state to a closed state to turn on the light source in response to pulling the trigger.

In another embodiment, a weapon emulator has a frame, a barrel and a trigger coupled to the frame, and a member coupled to the barrel and moveable relative to the barrel from a first position to the second position in response to pulling the trigger. A magnet is attached to the member, and a power source is coupled to the barrel. A muzzle flash emulator assembly includes a light source and a reed switch, wherein the magnet operatively aligns with the reed switch as the member moves from the first position to the second position, thereby closing the reed switch to complete a circuit between the power source and the light source.

In a further embodiment, a muzzle flash emulator is coupled to an end of a barrel and includes a light source, a power source coupled to the frame, and a switch transitionable from an open state where a circuit between the light source and the power source is open to a closed state where the circuit is closed. The muzzle flash emulator further includes a member coupled to the barrel and moveable relative to the barrel to strike the switch in response to pulling the trigger to transition the switch from the open state to the closed state.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
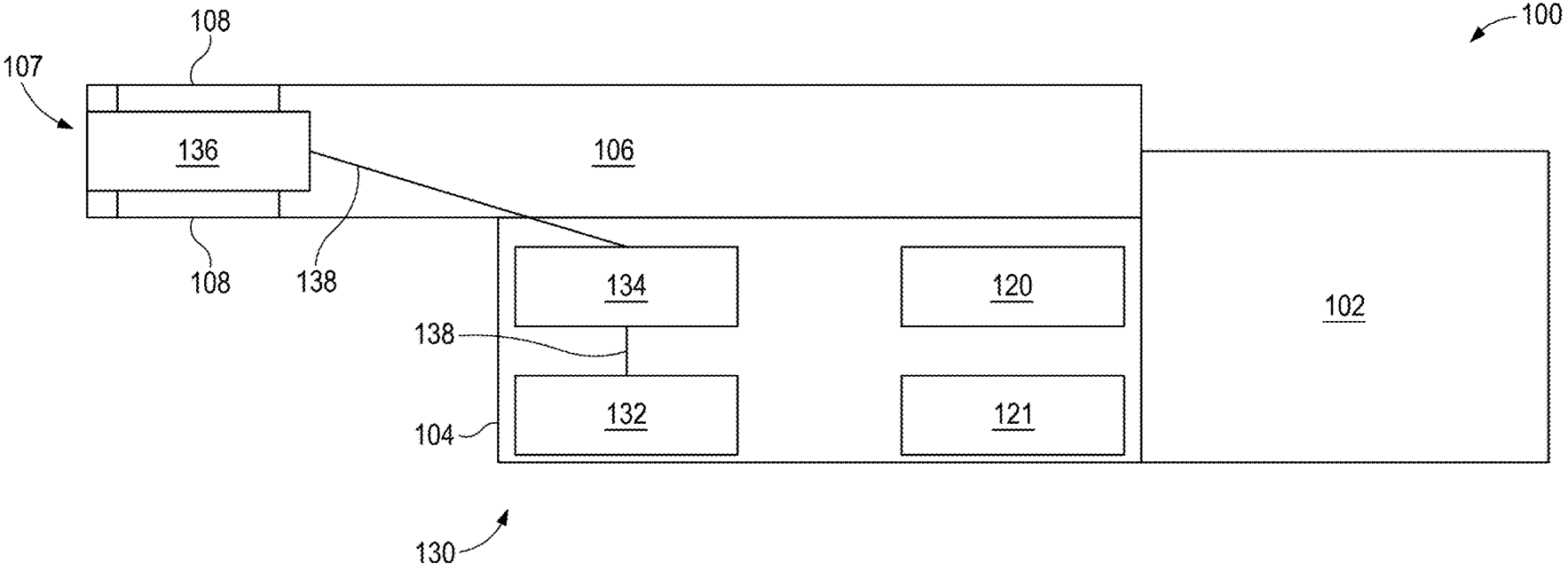
FIG. 1 is a schematic of a weapon emulator that may incorporate principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

The present disclosure relates generally to a weapon emulator and, more particularly, to prop firearms used during filming. The weapon emulator includes a light source, power source, and a switch. The switch can be selectively activated to complete a circuit between the power source and light source to produce a momentary flash of light that emulates a muzzle flash. The weapon emulators described herein imitate the muzzle flash without the use of blanks or life rounds, which advantageously reduces physical, legal, and cost concerns associated with using real or modified firearms during the production of a movie, TV show, video, or the like.

FIG. 1 illustrates a schematic of a weapon emulator 100. The weapon emulator 100 may be used as a prop during the filming of a movie, video, TV show, or other visual medium to safely emulate (e.g., simulate, mimic, imitate) a muzzle flash without firing a bullet or blank. Even though the weapon emulator 100 is schematically shown as a rifle, the weapon emulator 100 can take any form of a firearm needed for filing the desired scene, such as a modern-style rifle (e.g., AR-15, M-16), a machine gun, a shotgun, a pistol (e.g., semiautomatic pistol), a futuristic weapon (e.g., a blaster), or a historical firearm (e.g., flintlock gun, Colt pistol). In some embodiments, the weapon emulator 100 may be fabricated by retrofitting an existing firearm, replica airsoft gun, or existing prop firearm.

The weapon emulator 100 includes a frame 104 (e.g., receiver), a barrel 106, an action 120 including a trigger 121, and a muzzle flash emulator assembly 130. The frame 104, the barrel 106, and the trigger 121 may all be selected based on the desired weapon being emulated. In some embodiments, the weapon emulator 100 may include a stock 102 depending on the weapon being emulated. The trigger 121 is coupled to the frame 104. The muzzle flash emulator assembly 130 is activated in response to pulling the trigger 121 to emulate a muzzle flash. In some embodiments, the weapon emulator 100 may include other components that simulates firing a projectile in response to pulling the trigger 121. The action 120 may include one or more additional components, such as a hammer, that causes the weapon emulator 100 to simulate firing a shot in response to pulling the trigger 121. For example, the action 120 may be a pneumatic action that causes a burst of gas from a reservoir to be released. The burst of gas may be released into the barrel 106 to actuate a bolt (not shown) to simulate recoil or may be used to actuate a slide of a pistol to simulate firing. In some embodiments, the muzzle flash emulator assembly 130 is activated by a burst of gas released by pulling the trigger 121 or the movement of one or more components of the weapon emulator 100 set in motion in response to pulling the trigger 121. In some embodiments, the action 120 may be electric, such as having one or more actuators that moves one or more components (e.g., moves slide, simulates recoil) of the weapon emulator 100 in response to pulling the trigger 121 to provide realism to the weapon emulator 100.

The muzzle flash emulator assembly 130 includes a power source 132, a switch 134, and a light source 136. The power source 132 and switch 134 are part of a circuit connected to the light source 136. The switch 134 is transitionable between an open and closed state. When the switch 134 is open, the light source 136 does not produce light because the circuit is open (e.g., broken) and the light source 136 does not receive power from the power source 132. When the switch 134 is closed, the circuit is closed (e.g., completed) and the light source 136 receives power from the power source 132 and produces light that emulates a muzzle flash that can be filmed by a camera during the production of a movie, video, TV show, or the like.

The power source 132 may be a battery, such as a lithium-ion battery or other suitable battery type. In some embodiments, the power source 132 may be internal to the weapon emulator, such as being housed within the frame 104 (as shown), barrel 106, or stock 102. In other embodiments, the power source 132 may be external to the weapon emulator 100, such as being attached to the exterior of the frame 104 or barrel 106 but hidden by a cover. In some embodiments, the power source 132 may be housed within a magazine (see magazine 230 in FIG. 2B) that is coupled to the weapon emulator 100.

The switch 134 may be wired to both the power source 132 and the light source 136 as shown by the wires 138 in FIG. 1. The switch 134 is coupled to the weapon emulator 100, such as being attached to the frame 104 as shown in FIG. 1 or disposed in the barrel 106. The switch 134 may be transitioned between the open and closed state by operation of the action 120 or in response to direct contact by the trigger 121. The switch 134 is biased toward the open state to facilitate a momentary closing of the switch 134 so that the light source 136 produces short flashes of light that emulate a muzzle flash.

For example, the switch 134 may be positioned in the barrel 106 and may be transitioned from the open state to the closed state in response to a gas released into the barrel 106 by the action 120 that interacts with the switch 134. As another example, the switch 134 may be a reed switch, and the action 120 may cause a component of the weapon emulator 100 that has a magnet coupled thereto to momentarily interact with the reed switch to close the circuit. As another example, the switch 134 may be positioned on the frame 104 and transitioned from the closed state to the open state in response to contact by a component (e.g., bolt, bolt carriage) of the weapon emulator 100 moved in response to the action 120. As another example, the switch 134 may be positioned behind the trigger 121 and may be moved from the open state to the closed state in response to being contacted by the trigger 121.

The light source 136 may be one or more light emitting diodes (LEDs) or other suitable light emitting element. The light source 136 emits a flash of light that emulates a muzzle flash when the switch 134 is in the closed state. The light source 136 may be selected to be filmable in various lighting environments, including on location in bright daylight. For example, the light source 136 may be selected to produce flashes between 50 to 5000 lumens or more in certain lighting settings. The light source 136 may also be selected based on the desired color of the flash, such as being producing a yellow or amber light. The light is emitted for a short period of time due to the momentary closure of the switch 134, such as being emitted for a few milliseconds or a fraction of a second. The flashes and other motions of weapon emulator (e.g., recoil) can be captured by a camera during filming to safely simulate the operation of a firearm. Post-production editing can use the flashes produced by the weapon emulator, such as leaving the flashes as originally captured or touching up the captured flashes.

The light source 136 may be disposed in the bore of the barrel 106 near the muzzle end 107 as shown in FIG. 1. In some embodiments, the barrel 106 may optionally include one or more side slots 108 (e.g., windows) formed in a wall of the barrel 106 at the muzzle end 107 so that a portion of the light can be directed radially outward from the side of the barrel 106 to facilitate capturing the flash on the camera. The slots 108 may be arranged based on the desired viewing angle of the camera. For example, the weapon emulator 100 may have two slots 108 arranged 90 degrees apart (e.g., on the right and left sides of the barrel 106) that are arranged to facilitate filming the muzzle flash from the left or right side of the weapon emulator 100.

Figure 5B:
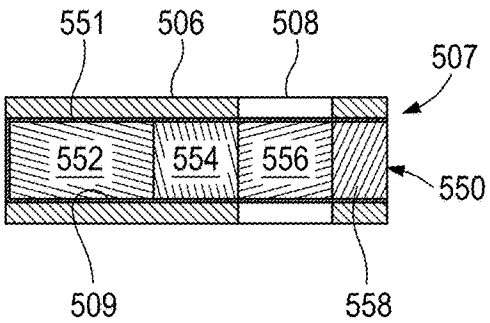
FIG. 5B illustrates a schematic cross-sectional view of the weapon emulator of FIG. 5B after the slide as moved to a second position.
Figure 5A:
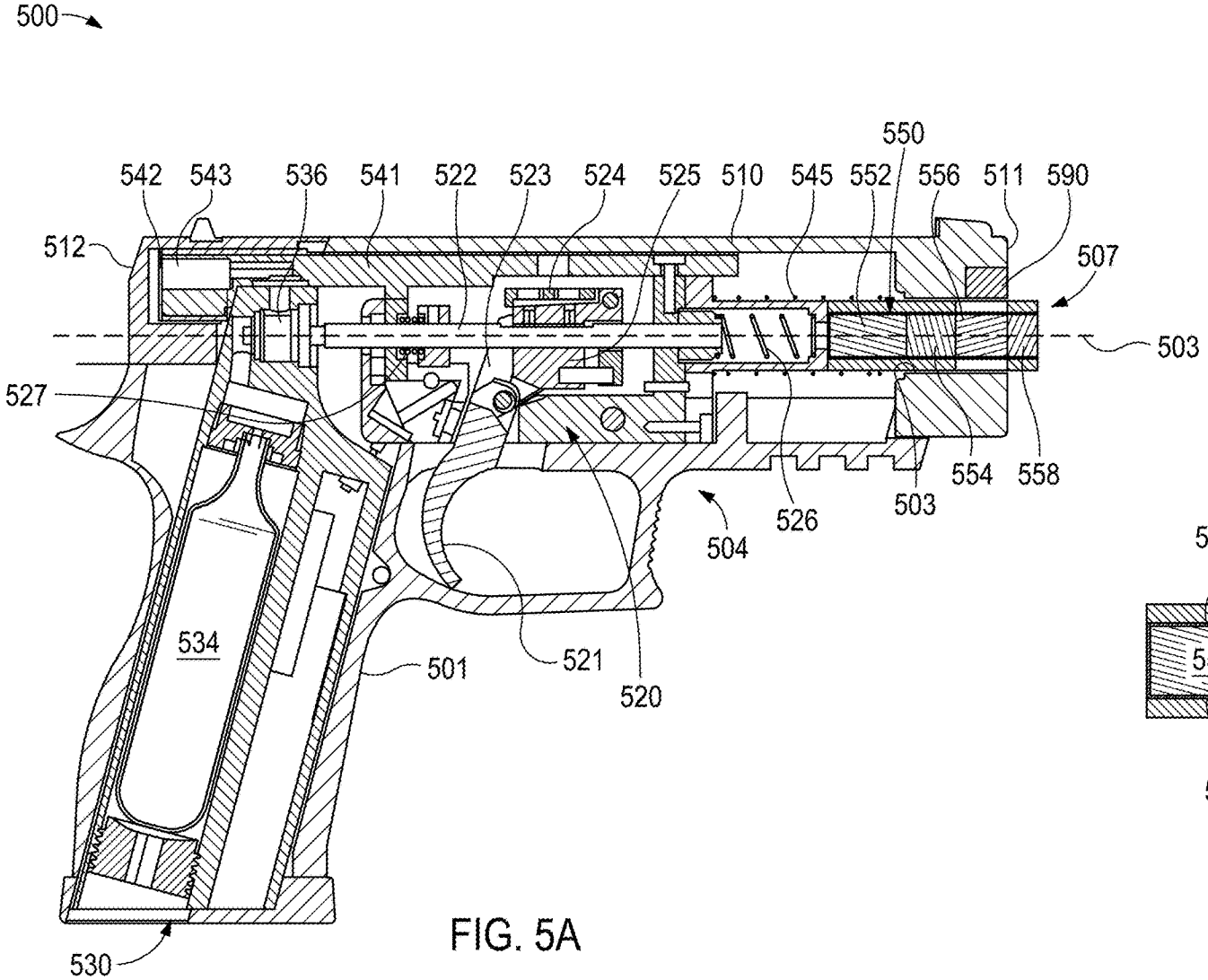
FIG. 5A illustrates a schematic cross-sectional view of a weapon emulator after pulling the trigger and prior to the slide thereof moving from a first position.

The slots 108 may ordinarily be hidden (e.g., occluded) by another component of the weapon emulator 100, such as a slide as shown in FIG. 5A, that can be moved due to operation of the action 120 to momentarily expose the slots 108. However, the momentary exposure of the slots 108 occurs within milliseconds which means that the slots 108 are not noticeable to audiences watching the camera footage at normal speeds. Hiding the slots adds realism to the weapon emulator 100 and avoids post-production editing to remove the slots 108 while the weapon emulator 100 is not simulating firing projectiles. Another portion of the light may exit the muzzle of the barrel 106, but a cap or other feature may be positioned to block light from exiting the muzzle to facilitate increasing the amount of light that exits through the slots 108. In some embodiments, the slots 108 in the barrel 106 may be omitted to provide greater realism to the look of the firearm being emulated. For example, a western style revolver (e.g., Colt revolver) does not have slots in the barrel or a component activated by the action that can be used to hide the slots.

In some embodiments, the light source 136 may be located in an attachment coupled to the muzzle end 107, such as being screwed onto the muzzle end 107. The attachment may emulate a flash hider. The attachment may include the one or more slots 108 instead of the barrel 106. Additionally, the attachment may also include the switch 134. In some embodiments, the attachment may include the power source 132, switch 134, and the light source 136.

In some embodiments, the weapon emulator 100 may include one or more light diffusion members to facilitate lingering (e.g., glow) of the flash. For example, the light source 136 may be housed in an cover within the barrel 106 formed from a material that diffuses light. The cover may be a diffusion paper or a frosted or etched plastic material, such as a frosted or etched polycarbonate sleeve or cover.

In some embodiments, the power source 132, the switch 134, and the light source 136 may each be housed in a different part of the weapon emulator 100. For example, the light source 136 may be located in the barrel 106, the switch 134 may be located in the frame 104, and the power source 132 may be located in a magazine coupled to the weapon emulator 100 or in the stock 102. In other embodiments, two or more components of the muzzle flash emulator assembly 130 may be located at the same component of the weapon emulator 100. For example, the power source 132 and switch 134 may both be located at the frame 104 while the light source 136 is located in the barrel 106 or in an attachment coupled to the muzzle end 107 of the barrel 106. In other embodiments, the components of the muzzle flash emulator assembly 130 may be located at the same component of the weapon emulator 100, such as being disposed in the barrel 106 or being incorporated into the attachment.

Figure 2A:
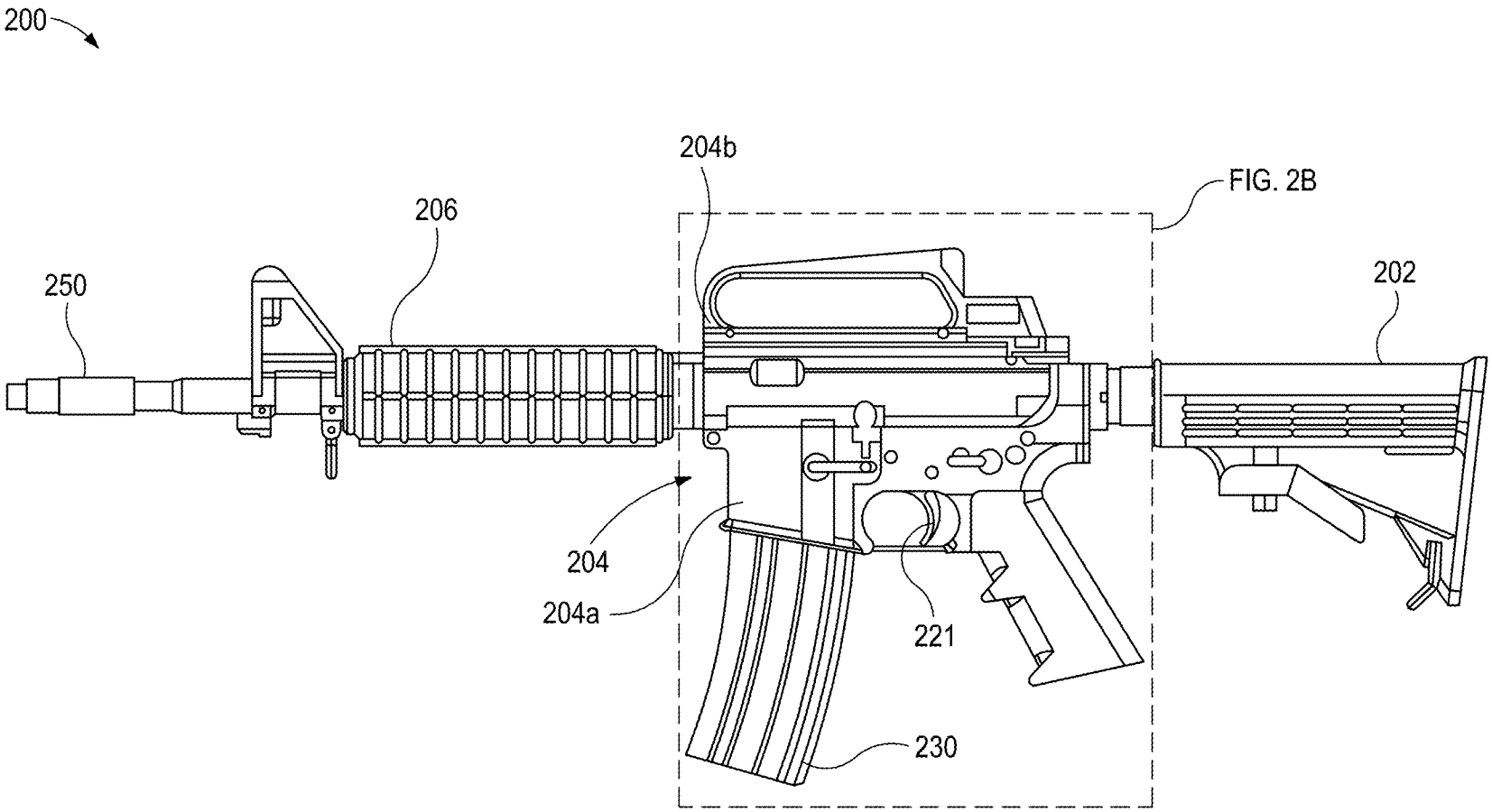
FIG. 2A is a side view of a weapon emulator with a muzzle flash emulator attachment that may incorporate principles of the present disclosure.
Figure 2B:
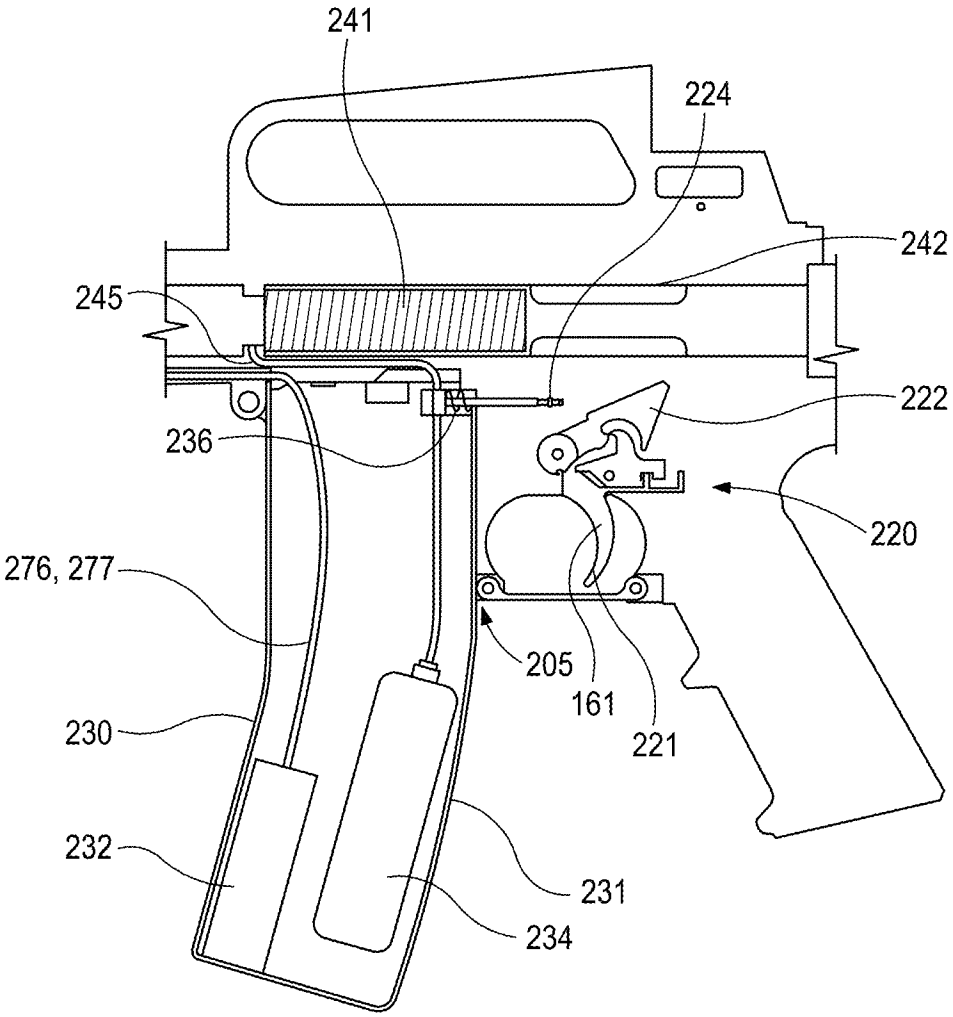
FIG. 2B is a schematic partial cross-sectional view of a portion of the weapon emulator shown in FIG. 2A.

FIGS. 2A-2B illustrate an exemplary embodiment of a weapon emulator 200 that includes a stock 202, a receiver 204, a barrel 206, an action 220 including a trigger 221, a magazine 230, a bolt 241, a bolt chamber 242, a gas channel 245, and an attachment 250 (e.g., muzzle flash emulator attachment) coupled to the muzzle end of the barrel 206. FIG. 2A illustrates a side view of the weapon emulator 200. FIG. 2B illustrates schematic cross-sectional view of the weapon emulator 200 within the dashed region shown in FIG. 2A. The weapon emulator 200 is shown as emulating a modern style assault rifle (e.g., AR-15).

The receiver 204 is the central body of the weapon emulator 200 and the component to which the magazine 230 is attached via a port 205 along the bottom of the receiver 204. The receiver 204 includes an upper receiver 204*a* that is coupled to the barrel 206 and houses the bolt 241 and a lower receiver 204*b* that houses the action 220 and receives the magazine 230 within the port 205.

The action 220 is positioned within the lower receiver 204*b* adjacent to the port 205. The action 220 is similar to that of a traditional firearm and includes the trigger 211 and a hammer 222. The trigger 221 extends out of the receiver 204, such that the trigger 221 may be pulled by a user. The action 220 also includes a gas release pin 224 that can be struck by the hammer 222 to open a release valve 236 to release gas from a gas container 234 disposed within the magazine 230 into bolt chamber 242 through the gas channel 245 that extends through the lower receiver 204*b*.

The barrel 206 is positioned such that it is concentric with the bolt chamber 242. The bolt chamber 242 is a cylindrical channel that traverses into the receiver 204. The bolt 241 is spring loaded and slidable within the bolt chamber 242. When the trigger 221 is pulled, the bolt 241 is forced towards the back of the receiver 204 in order to simulate the recoil of a real firearm due to the gas entering the bolt chamber 242 via the gas channel 245. The bolt 241 compresses a bolt spring (not shown) as the bolt 241 moves towards the back of the receiver 204. The bolt 241 also acts to reset the hammer 222 as the bolt 241 traverses along the bolt chamber 242 towards the back of the receiver 204. The bolt spring thereafter expands and causes the bolt 241 to move forward toward an unfired position shown in FIG. 2B.

In reference to FIG. 2B, the magazine 230 includes a magazine casing 231, the gas container 234, and the release valve 236. The gas container 234 is a pressure vessel in the magazine casing 231 that stores a compressed gas (e.g., compressed air). The release valve 236 is coupled to the gas container 234 and is used to regulate the release of compressed gas from the gas container 234. The release valve 236 is positioned within the magazine casing 231 such that the release valve 236 can be actuated by the gas release pin 224. The gas container 234 is in fluid communication with the gas channel 245 through the release valve 236 when the magazine 230 is received within the port 205.

The hammer 222 is spring loaded and is held in a compressed state through a mechanical coupling to the trigger 221. When the trigger 221 is pulled back, the hammer 222 is released from the compressed state and pivots within the receiver 204 to engage the gas release pin 224. The gas release pin 224 is pushed forward by the hammer 222 to open the release valve 236, which in turn allows gas to flow the gas channel 245 from the gas container 234 and into the bolt chamber 242. The release valve 236 is spring loaded, which allows the release valve 236 to close communication through the gas channel 245 and force the gas release pin 224 back into a unfired position shown in FIG. 2B when the hammer 222 is reset. As the bolt 241 traverses along the bolt chamber 242, the gas that entered into the bolt chamber 242 is directed through the barrel 206 towards the attachment 250.

Figure 2D:
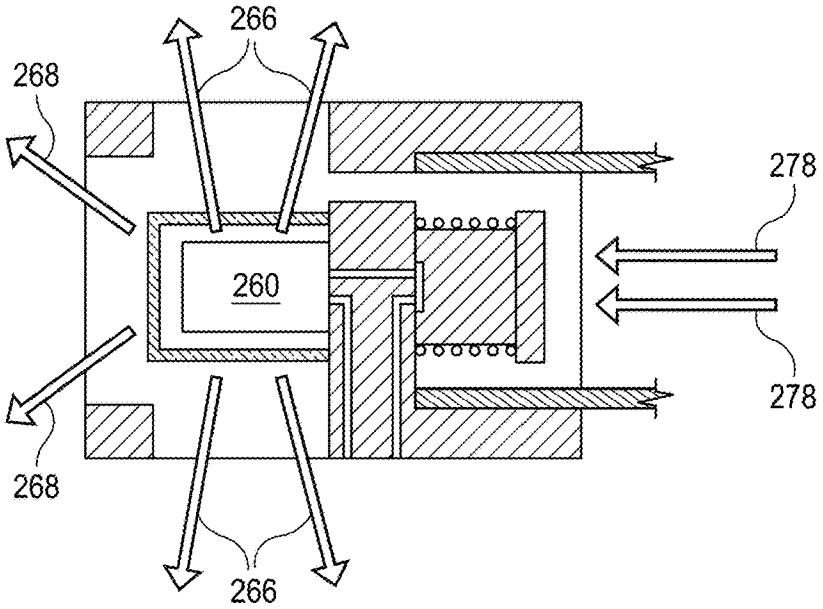
FIG. 2D illustrates a schematic cross-sectional view of the muzzle flash emulator attachment of FIG. 2A with the switch thereof in a closed state.
Figure 2C:
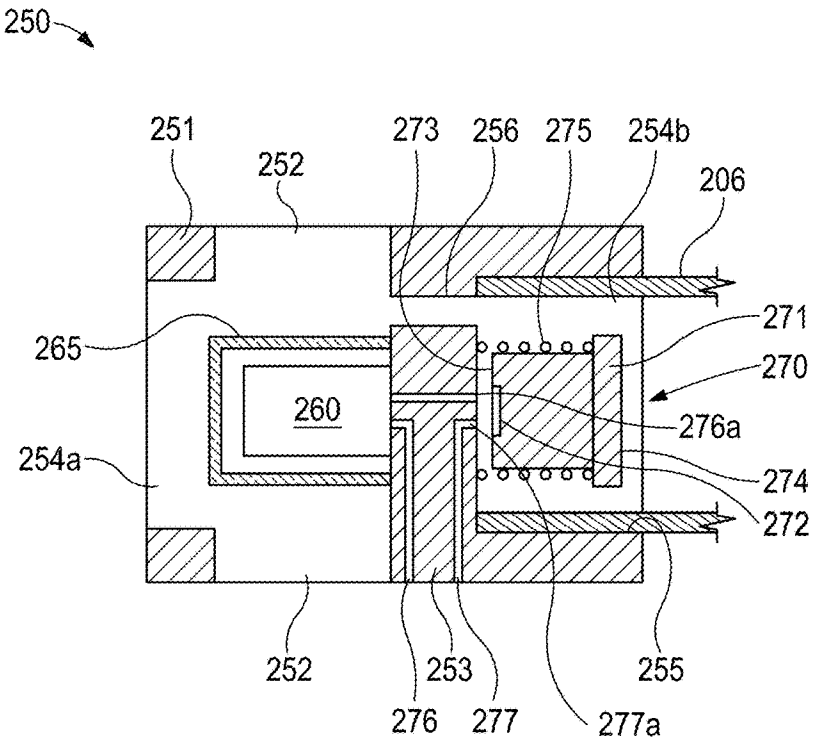
FIG. 2C illustrates a schematic cross-sectional view of the muzzle flash emulator attachment of FIG. 2A with a switch thereof in an open state.

FIGS. 2C-2D illustrate a schematic cross-sectional view of the attachment 250, which is a muzzle flash emulator, that is electrically connected to a power source 232. The attachment 250 includes a light source 260 and a switch 270 that is part of a circuit with the power source 232. The power source 232 and attachment 250, including the light source 260 and switch 270, make up the muzzle flash emulator assembly of the weapon emulator 200.

Referring to FIG. 2C, the attachment 250 includes a body 251 that defines a plurality of slots 252 that are arranged at different radial positions around the longitudinal axis of the body 251. The body 251 may include a wall 253 that separates a first cavity 254*a* defined by the body 251 that houses the light source 260 from a second cavity 254*b* defined by the body 251 that receives the muzzle end of the barrel 206. The inner surface 255 of the body 251 defining the second cavity 254*b* may include threads to facilitate threading the attachment 250 onto the barrel 206. The wall 253 may include one or more vents 256 to allow the gas to exit the barrel 206.

The light source 260 is attached to the body 251, such as being attached to the wall 253. The light source 260 may be one or more LEDs or other suitable light emitting element that produces a simulated muzzle flash of a quality that can be captured by a camera when shooting a scene for a film, video, TV show, or the like. The light source 260 may be selected to be filmable in various lighting environments, including on location in bright daylight. For example, the light source 260 may be selected to produce flashes between 50 to 5000 lumens or more in certain lighting settings. The light source 260 is turned on to emit light once the switch 270 is in a closed state (FIG. 2D) and is otherwise turned off while the switch 270 is in an open state, such as the fully open state shown in FIG. 2C.

The light source 260 may be at least partially surrounded by a cover 265 formed from a light diffusing material, such as a diffusion paper or a frosted or etched plastic cover. The light diffusion material helps the light linger to emulate the glow of a muzzle flash. In some embodiments, the cover 265 may be a transparent cover over the light source 260 that houses a light diffusion member, such as diffusion paper. The light source 260 and cover 265 are aligned with the slots 252 as shown in FIG. 2C. A portion of the light emitted by the light source 260 exits the attachment 250 through the slots 252 as illustrated the arrows 266 which facilitate capturing the emulated flash by the camera. In some embodiments, another portion of the light may be allowed to exit the front of the attachment 250 as shown by arrows 268. However, the attachment 250 may include a cap that blocks the exit of light through the front of the attachment 250 to increase the amount of light that exits through the slots 252.

The switch 270 includes a switch member 271 that is disposed in the second cavity 254*b*. The switch member 271 includes an electrode 272 attached to or embedded in a first end 273 thereof. The switch 270 is in the closed state shown in FIG. 2D when the switch member 271 is positioned to engage the electrode 272 with a contact 276*a*, 277*a* (e.g., leads) of respective wires 276, 277 that extend to the power source 232, thereby completing the circuit between the power source 232 and the light source 260. The switch member 271 is biased towards the fully open state shown in FIG. 2C by a biasing member 275 (e.g., spring) disposed around the switch member 271.

The switch 270 is transitioned from the open state to the closed state by the gas released by pulling the trigger 221. FIG. 2D represents the gas flow by arrows 278. The force applied to the second end 274 of the switch member 271 by the gas overcomes the biasing force of the biasing member 275 to transition the switch 270 to the closed state. The biasing member 275 returns the switch 270 to the open state once the gas pressure drops such that the biasing force exceeds the force applied by the gas. The pressure of the gas quickly dissipates causing the switch 270 to be closed momentarily which causes the light source 260 to emit a flash of light that simulates a muzzle flash. For example, the switch 270 may be in a closed state for a few milliseconds or a fraction of a second. Additionally, the weapon emulator 200 may be used to simulate a fully automatic firearm by emulating muzzle flashes occurring in rapid succession due to the distinct pressure pules acting on the switch 270.

The wires 276, 277 are shown exiting a side of the attachment 250. The wires 276, 277 may partially extend along the exterior of the barrel 206. The portions of the wires 276, 277 that extend on the exterior of the weapon emulator 200 will be hidden from the camera to enhance realism. The wires 276, 277 may be hidden by a cover or painted to camouflage the wires 276, 277. In some embodiments, the wires 276, 277 may extend through the bore of the barrel 206, such as the wire 276, 277 exiting a back side of the attachment 250 and entering the barrel 206.

Figure 3B:
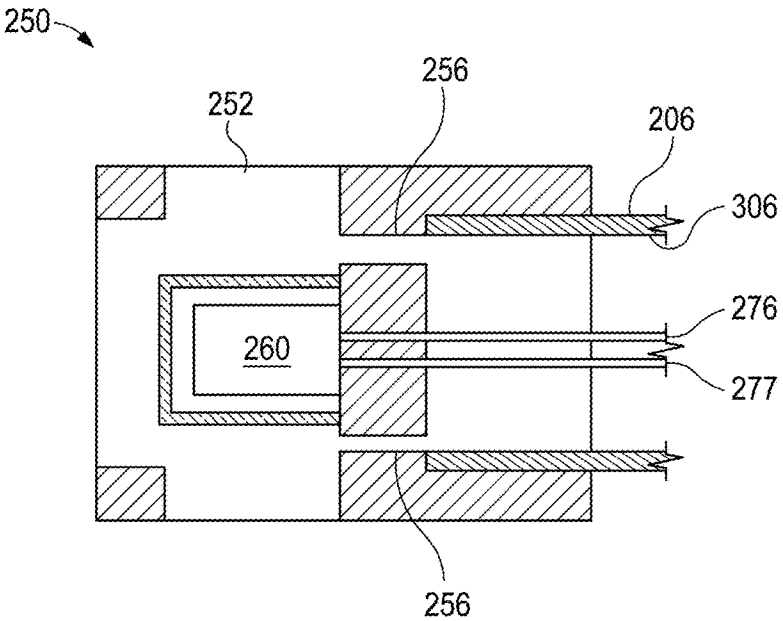
FIG. 3B illustrates a schematic cross-sectional view of the muzzle flash emulator attachment connectable to the weapon emulator shown in FIG. 3A.
Figure 3C:
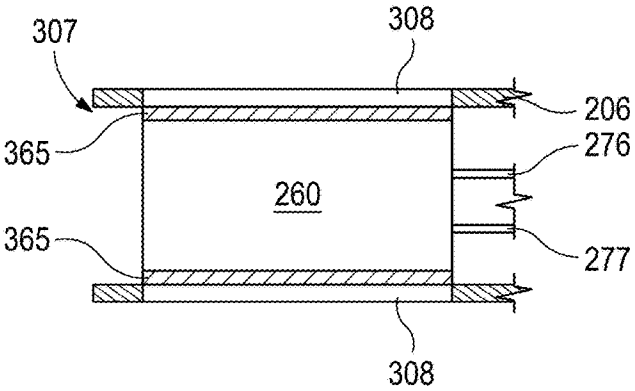
FIG. 3C illustrates a muzzle flash emulator disposed in a bore of a barrel of the weapon emulator shown in FIG. 3A.
Figure 3A:
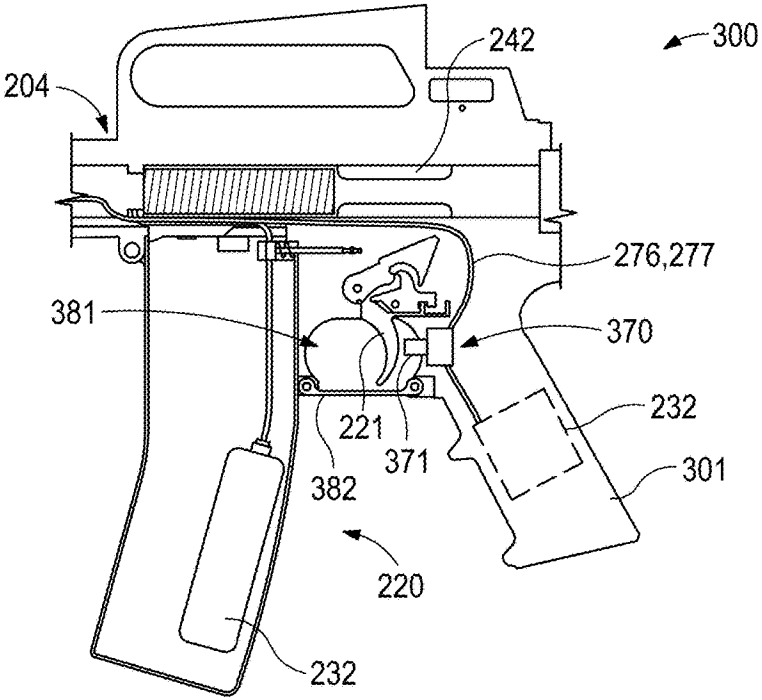
FIG. 3A is a schematic cross-sectional view of a weapon emulator that may incorporate principles of the present disclosure.

FIGS. 3A-3C illustrate an exemplary weapon emulator 300. The weapon emulator 300 may be similar to weapon emulator 200, and the similar components will not be redescribed here for the sake of brevity. Weapon emulator 300 includes a switch 370 that is engageable by the trigger 221 to selectively complete a circuit to turn on and off the light source 260. As shown in FIG. 3A, the switch 370 coupled to the receiver 204 and positioned behind the trigger 221. Pulling the trigger 221 causes the switch 370 to transition from an open state to a closed state, thereby completing a circuit between the power source 232 and the light source 260. While the power source 232 is shown as being housed in in a grip 301 of the receiver 204, the power source 232 may be housed in the magazine 230, in the stock 202, or attached to the side of the barrel 206 in a camouflaged housing to obscure the power source 232 from the camera.

The switch 370 may be a button-type switch with a button 371 biased toward an extended (e.g., undepressed) position that can be depressed by the trigger 221 to a depressed (e.g., retracted) position. For example, the button 371 may be biased toward the extended position by a spring or other suitable biasing member. The switch 370 is in the open state while the button is in the extended position and in the closed state while the button is in the depressed position. The switch 370 may be positioned such that the button 371 at least partially extends into a trigger well 381 defined between the receiver 204 and trigger guard 382 as shown in FIG. 3A.

In some embodiments, the weapon emulator 300 may include an attachment 350 (e.g., muzzle flash emulator attachment) fixed to the end of the barrel 206 that includes the light source 260 and the cover 265. FIG. 3B illustrates a cross-section view of the attachment 350 which is similar to the attachment 250 shown in FIG. 2C. The attachment 350, however, does not include a switch since the weapon emulator 300 has the switch positioned behind the trigger 221. The wires 276, 277 that extend between the light source 260 and the switch 370 may therefore extend partially through the barrel 206, such as extending through the bore 306 and the bolt chamber 242 as shown in FIG. 3B. Gas released from gas container 234 may exit the barrel 206 through the vents 256 formed in the attachment 350.

In some embodiments, and as shown in FIG. 3C, the light source 260 is disposed in the barrel 206 adjacent to the muzzle 307 of the barrel 206 rather than being housed in the attachment 350. The barrel 206 may optionally include a plurality of slots 308 arranged at different positions around the light source 260 similarly to the slots 252 of the attachment 350. The light source 260 may be at least partially surrounded by a diffusion member 365, such as diffusion paper or a frosted or etched plastic member (e.g., frosted polycarbonate sleeve) to facilitate emulating the glow of a muzzle flash. The diffusion member 365 and light source 260 are aligned with the slots 308. The wires 276, 277 may similarly partially extend through the barrel 206. The slots 308 may be incorporated into the barrel 206 when the weapon being emulated has a component that can selectively hide the slots 308 from the camera when the weapon emulator 300 is not being used to simulate firing a projectile. For example, the weapon emulator 300 may be a pistol that has a slide that can briefly expose the slots 252 to allow the camera to capture the flash as the slide moves in response to gas released from the gas container 234.

The switch 370 is depressible in response to the trigger 221 rather than being depressed in response to the release of a gas or movement of a component of the weapon emulator 300 set in motion by pulling the trigger 221. The switch 370, therefore, is suitable for a weapon emulator that does not have components set in motion in response to pulling the trigger 221 to maintain realism for the camera. For example, using the switch 370 and the light source 260 may be sufficient to emulate firing a prop shotgun, such as a double-barreled shotgun.

Figure 4B:
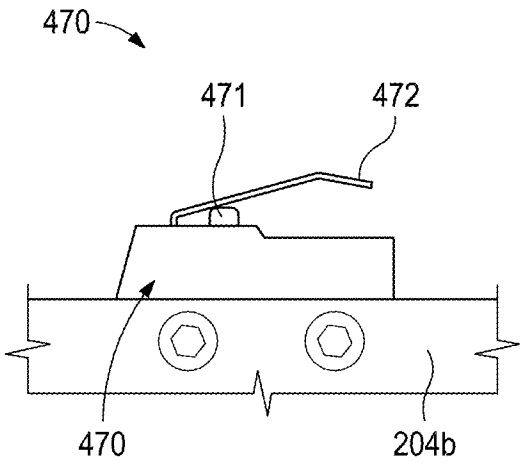
FIG. 4B illustrates a schematic side view of the switch of FIG. 4A.
Figure 4A:
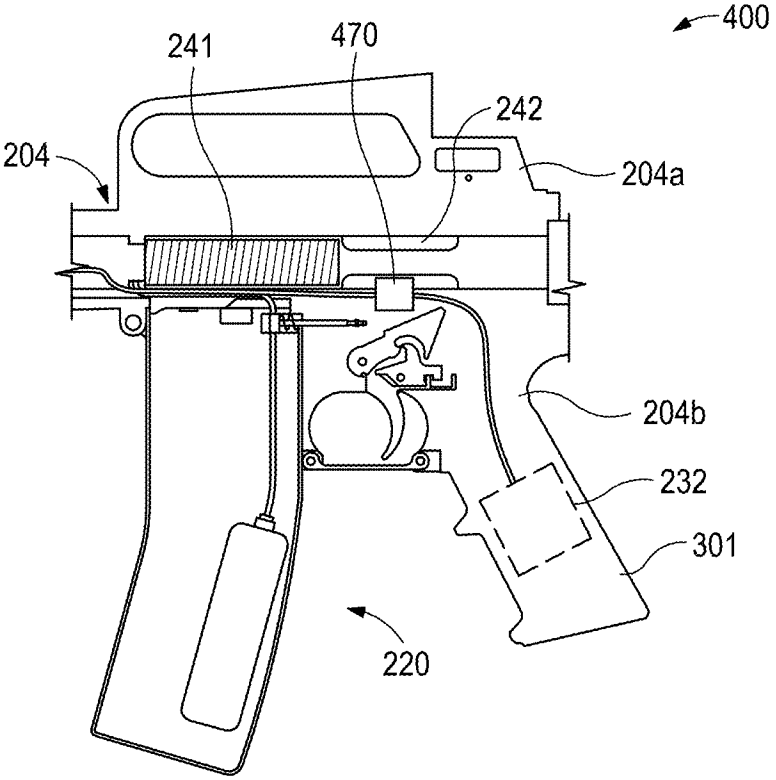
FIG. 4A is a schematic cross-sectional view of a weapon emulator with a switch engageable by a reciprocating bolt that may incorporate principles of the present disclosure.

FIGS. 4A-4B illustrate an exemplary weapon emulator 400. The weapon emulator 400 may be similar to weapon emulator 200, and the similar components will not be redescribed here for the sake of brevity. Weapon emulator 400 includes a switch 470 that is engageable by a component set in motion by the action 220 to selectively complete a circuit to turn on and off the light source 260 (not shown in FIG. 4A or 4B).

The switch 470 is shown partially disposed in the bolt chamber 242, such as being mounted to the lower receiver 204*b*. The bolt 241 strikes the switch 470 while moving towards the back of the receiver 204 which transitions the switch 470 from the open state to the closed state to complete the circuit between the power source 232 and the light source 260 to emulate the muzzle flash. The forward motion of the bolt 241 disengages the switch 470 which allows the switch to return to the open state to turn off the light source 260.

FIG. 4B illustrates a simplified schematic view of the switch 470. The switch 470 may have a button 471 (e.g., switch member) an a flexible member 472 (e.g., a tab, lever member) that is engageable with the bolt 241. In the open state, the button 471 is in an extended position such that an electrode connected to the button 471 does not complete the circuit between the power source 232 and the light source 260. In the closed state, the button 471 is in a depressed position such that the electrode completes the circuit and causes the light source 260 to emit light. The button 471 is biased toward the extended state to break the circuit once the bolt 241 has moved out of engagement with the flexible member 472. In some embodiments, the weapon emulator 400 may include a bolt carriage or other member that strikes the flexible member 472 instead of the bolt 241.

The flexible member 472 may be formed from a metallic material. The backwards movement of the bolt 441 contacts the flexible member 472 which then deforms to press the button 471. The flexible member 472 is biased towards a disengaged position shown in FIG. 4B where the flexible member 472 allows the button 471 to return to the retracted position. In some embodiments, and as shown in FIG. 4B, the flexible member 472 may be out of contact with the button 471 when in the disengaged position. The flexible member 472 may be shaped to facilitate the movement of the bolt 241 without impeding the bolt 241 or becoming caught by the bolt 241.

In some embodiments, the weapon emulator 400 may include the attachment 350 fixed to the end of the barrel 206 that includes the light source 260 and the cover 265. In other embodiments, the weapon emulator 400 may instead have the light source 260 disposed in the bore of the barrel 206, such as being disposed at the muzzle end adjacent to a plurality of slots 308 formed in the barrel 206.

The wires 276, 277 that extend between the light source 260 and the switch 470 may therefore extend partially through the barrel 206, such as extending through the bore 306 and the bolt chamber 242 as shown in FIG. 3B. While the power source 232 is shown as being housed in in the grip 301 of the receiver 204, the power source 232 may be housed in the magazine 230, in the stock 202, or attached to the side of the barrel 206 in a camouflaged housing to obscure the power source 232 from the camera.

FIG. 5A illustrates a schematic cross-sectional view of an exemplary weapon emulator 500 which is configured to emulate a semiautomatic pistol. The weapon emulator 500 includes a frame 504, a barrel 506, a slide 510, an action 520 including a trigger 521, a magazine 530, a muzzle flash emulator assembly 550, and a magnet 590. The slide 510 selectively moves the magnet 590 (e.g., permanent magnet) into an operational position (e.g., operational alignment) to cause the muzzle flash emulator assembly 550 to produce a flash of light that emulates a muzzle flash. While weapons emulator 500 is shown as a semiautomatic pistol for illustrative purposes, the weapons emulator 500 may take the form of another type of firearm, such as a machine gun or rifle.

The frame 504 includes a grip 501 and a port configured to receive the magazine 530. The magazine 530 contains a gas container 534 and a release valve 536. The slide 510 is coupled to the frame 504. The slide 510 reciprocates longitudinally with respect to the frame 504 and the barrel 506 between a first position shown in FIG. 5A and a second position (FIG. 5B) to simulate firing a projectile from the barrel 506. The slide 510 includes a front end 511 (e.g., muzzle end) and a rear end 512. The front end 511 includes a muzzle opening 513. The barrel 506, which is coupled to the frame 504, extends through the muzzle opening 513. A plurality of slots 508 may optionally be formed in the wall of the barrel 506 adjacent to a muzzle end 507 of the barrel 506. The slots 508 may be arranged around the barrel 506 in a configuration to direct light in a plurality of radial directions relative to a longitudinal axis 503 (see FIG. 5B) of the barrel 506 to facilitate capturing the simulated muzzle flash by a camera. The slots 508 are obscured from the camera (e.g., disposed in the muzzle opening 513) when the slide 510 is in the first position and exposed to the camera as the slide 510 moves toward the second position, such as being fully exposed when the slide 510 is in the second position as shown in FIG. 5B.

The weapon emulator 500 also includes a piston 541 and piston sleeve 542 that are housed within the frame 504 and the slide 510. The piston 541 is positionally fixed to the frame 504 while the piston sleeve 542 is slidable relative to the piston 541 and the frame 504. The piston 541 and piston sleeve 542 define a piston chamber 543. As will be explained below, pulling the trigger 521 causes the firing pin 522 to actuate the release valve 536. Actuating the release valve 536 causes compressed gas from the gas container 534 to enter the piston chamber 543. Expansion of the gas in the piston chamber 543 causes the piston sleeve 542 to move backward relative to the piston 541 and frame 504. The slide 510, which is coupled to the piston sleeve 542, is moved backwards from the first position to the second position due to the movement of the piston sleeve 542 to expose the slots 508. The slide 510 is returned to the first position to occlude the slots 508 by spring 545 that is shown being engaged at one end to a flange of the barrel 506 and engaged at the other end to the slide 510. The slide 510 is biased towards the first position by a spring 545. The spring 545 is compressed as the slide 510 moves toward the second position and expands towards the neutral state shown in FIG. 5A to return the slide 510 to the first position.

The action 520 includes the trigger 521, the firing pin 522, a trigger hook 523, and a sear 524 coupled to a sear block 525. The pivoting movement of the trigger 521 initially translates the sear 524. The continued pivoting movement of the trigger 521 eventually brings the trigger hook 523 out of engagement with the sear 524, which permits longitudinal movement of the sear block 525 and the firing pin 522 towards the release valve 536. In other words, the firing pin 522 is understood to be releasably engaged to the trigger 521 by way of the sear 524 and the sear block 525. Upon being released, the firing pin 522 moves rearward to strike the release valve 536 to allow gas to flow to the piston chamber 543 to actuate the slide 510. The firing pin 522 is biased towards the release valve 536 by a firing pin spring 526. The firing pin 522 is returned to an unfired position by a counter spring 527.

FIG. 5A illustrates the weapon emulator 500 after the trigger 521 has been pulled with the firing pin 522 having moved backwards to open the release valve 536 to begin allowing gas to enter the piston chamber 543. The slide 510, however, has not yet begun to move backwards from the first position. FIG. 5B illustrates a schematic cross-sectional view of the weapon emulator 500 showing the slide 510 in the second position due to the expansion of the gas. The firing pin 522 is no longer applying sufficient force to the release valve 536 due to the counter spring 527 which has allowed the release valve 536 to close.

Figure 5C:
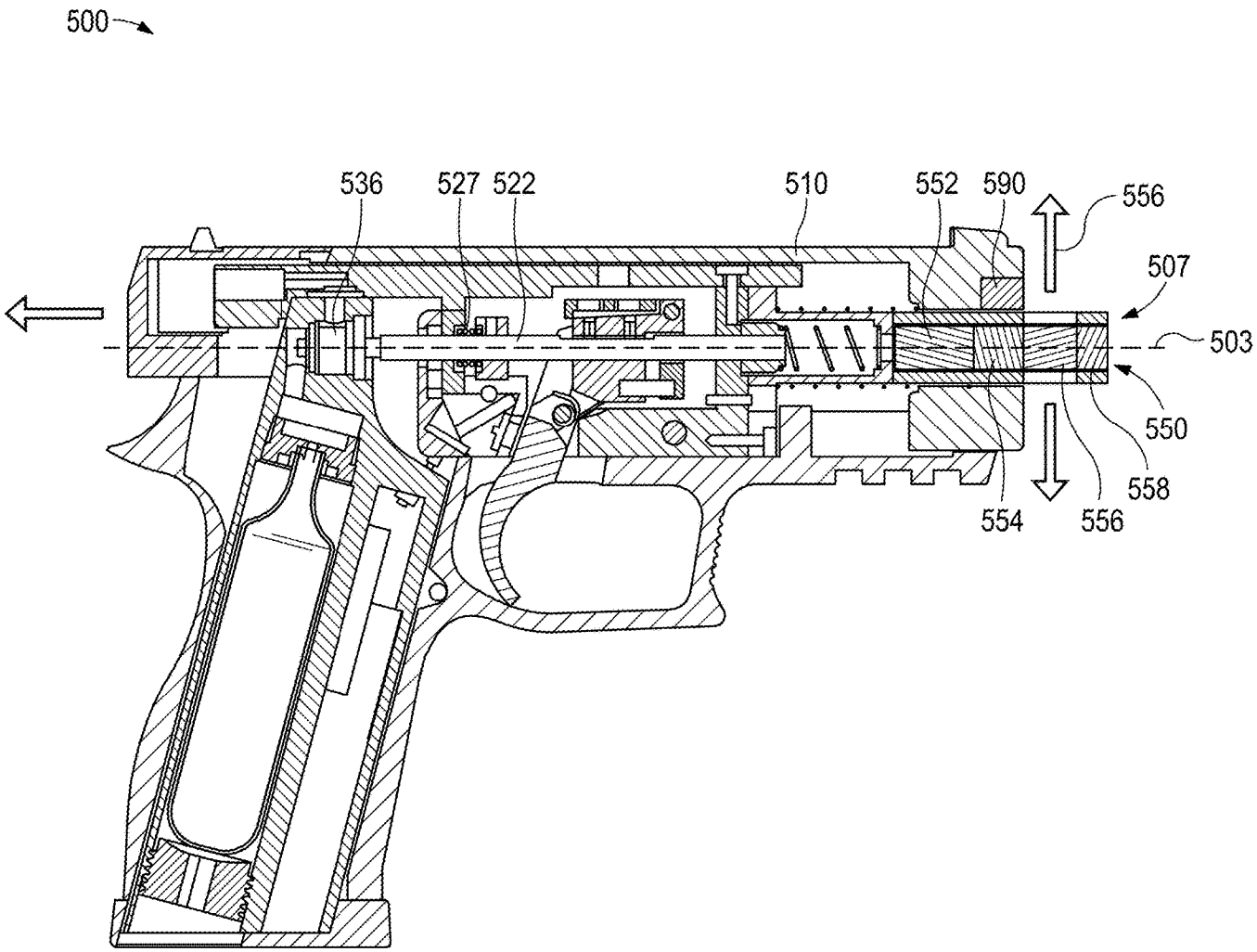
FIG. 5C is an enhanced cross-sectional view of a portion of the weapon emulator shown in FIG. 5A to better illustrate a muzzle flash emulator assembly disposed in a barrel of the weapon emulator.

FIGS. 5A-5C illustrate the muzzle flash emulator assembly 550 is disposed in a bore 509 of the barrel 506. FIG. 5C illustrates an enhanced cross-sectional view of the muzzle end 507 to better illustrate a simplified schematic representation of the muzzle flash emulator assembly 550. The muzzle flash emulator assembly 550 includes a power source 552 (e.g., a battery), a reed switch 554, and a light source 556. The muzzle flash emulator assembly 550 may also include a housing 551 in which the power source 552, Reed switch 554, and light source 556 are disposed. The housing 551 may be cylindrical tube, such as being an open-ended cylindrical tube. While not shown, the power source 552, reed switch 554, and light source 556 are connected together by wires.

The reed switch 554 is moved from an open state to a closed state in response to a magnetic field generated by the magnet 590 mounted to the slide 510. In the open state, the light source 556 is turned off because the circuit between the power source 552 and light source 556 is broken. In the open state, the light source 556 is turned on because the circuit is complete. FIG. 5A shows the magnet 590 being misaligned with the reed switch 554 such that the reed switch is in the open state. The magnet 590 moves into operational alignment with the reed switch 554 as the slide 510 moves toward the second position in response to pulling the trigger 521. FIG. 5B illustrates the magnet 590 in an operational alignment with the reed switch 554 such that the light source 556 is producing light. The reed switch 554 is returned to the open state when the magnet 590 moves out of operational alignment as the slide 510 returns to the first position.

In some embodiments, the magnet 590 is positioned on the slide 510 so that the light source 556 produces light, shown by arrows 566, when the slots 508 are exposed. For example, the magnet 590 may be positioned so that the Reed Switch 554 is closed to allow the light source 556 to produce light when the slots 508 begin to be exposed or when the slots 508 are fully exposed. In other words, the magnet 590 may be positioned to time the emitted flash from the light source 556 with the exposure of the slots 508 due to the movement of the slide 510. In some embodiments, and as shown in FIG. 5A, the magnet 590 is mounted to the interior of the slide 510 to hide the magnet 590 from the camera. However, the magnet 590 may be have sufficient strength to be mounted on the outside of the slide 510 while causing the Reed Switch 554 to change to the closed state. The magnet 590 may be camouflaged from the camera by a cover or other component when mounted to the exterior of the slide 510.

The light source 556 may be one or more LEDs or other suitable light emitting element that produces a simulated muzzle flash of a quality that can be captured by a camera when shooting a scene for a film, video, TV show, or the like. The light source 556 may be selected to be filmable in various lighting environments, including on location in bright daylight. For example, the light source 556 may be selected to produce flashes between 50 to 5000 lumens or more in certain lighting settings. In some embodiments, the housing 551 may be formed from a light diffusing material to help emulate the glow of a muzzle flash as the light generated by the light source 556 passes through the housing 551. For example, the housing 551 may be made from a frosted or etched material, such as polycarbonate. In some embodiments, the power source 552 may not be disposed in the housing 551. The power source 552 may located in a different part of the weapon emulator 500, such as being located in the magazine 530.

The muzzle flash emulator assembly 550 may optionally include an end cap 558 positioned closer to the muzzle end 507 than the power source 552, reed switch 554, and light source 556. The end cap 558 closes the open end of the housing 551 to facilitate directing the light out of the slots 508 rather than exiting out the muzzle of the barrel 506. The end cap 558 may be formed from a non-transparent material, such as a plastic. The end cap 558 may also have a reflective surface or coating that facilitates redirecting the light out of slots 508.

As shown in FIGS. 5A-5B, the light source 556 is aligned with slots 508 of the barrel 506. The slots 508 are arranged at different radial positions to facilitate capturing the emulated flash on camera. The slide 510 reciprocates quickly, which causes the slots 508 to be exposed momentarily. This momentary exposure of the slots 508 occurs within milliseconds which means that the slots 508 are not noticeable to audiences watching the camera footage at normal speeds. Hiding the slots 508 adds realism to the weapon emulator 500 and avoids post-production editing to remove the slots 508 while the weapon emulator 500 is not simulating firing projectiles. The weapon emulator 500 may include two or more slots 508, such three, four, five, six, seven, or eight slots. The slots 508 may be arranged based on the desired viewing angle of the camera. For example, the weapon emulator 500 may have two slots 508 arranged 90 degrees apart (e.g., on the right and left sides of the barrel 506) that are arranged to facilitate filming the muzzle flash from the left or right side of the weapon emulator 500.

Figure 5E:
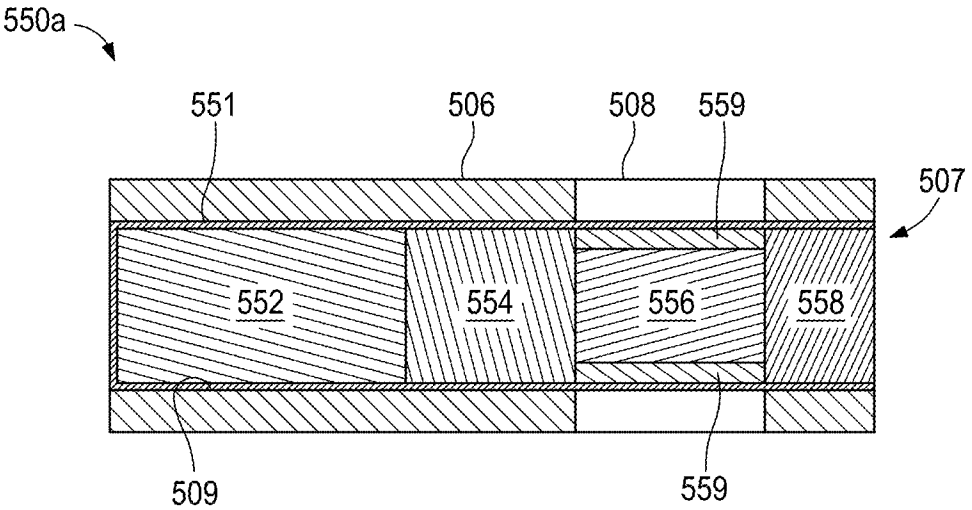
FIG. 5E illustrates an enhanced cross-sectional view of a portion of the weapon emulator shown in FIG. 5A to better illustrate an alternative muzzle flash emulator assembly disposed in a barrel of the weapon emulator.
Figure 5D:
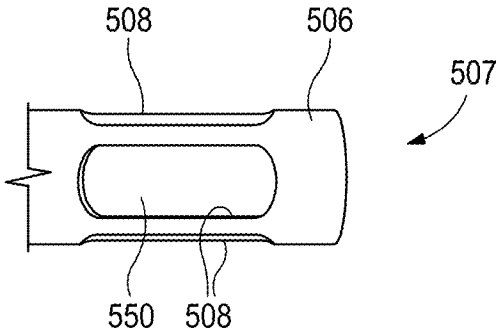
FIG. 5D is a perspective view of a portion of a barrel showing an arrangement of slots formed in the barrel.

FIG. 5D illustrates a perspective view of the muzzle end 507 of the barrel 506 to illustrate an exemplary arrangement of the slots 508 with the muzzle flash emulator assembly 550 being viewable through the slots 508. As shown, the barrel 506 includes three slots 508 spaced about 90 degrees apart. The barrel 506 is oriented such that the slots 508 generally face upwards, to the left, or to the right. In other words, the slots 508 are arranged so that the muzzle flash can be filmable from a position above, to the left, or to the right of the weapon emulator 500. In some embodiments, a barrel 506 may include one or more slots 508 arranged to allow the muzzle flash to be filmed from below the weapon emulator 500.

FIG. 5E illustrates an alterative muzzle flash emulator assembly 550*a* that can be disposed in the barrel 506 of the weapon emulator 500. The muzzle flash emulator assembly 550*a* differs from muzzle flash emulator assembly 550 in that the light source 556 is at least partially disposed within a light diffusion member 559 that is similarly disposed within the housing 551. The light diffusion member 559 is configured to diffuse the light to emulate the glow of a muzzle flash. In some embodiments, the diffusion member 559 may be a frosted or etched plastic sleeve, such as being a frosted or etched polycarbonate. In other embodiments, the diffusion member 559 may be diffusion paper wrapped around the light source 556. In some embodiments, the housing 551 may be formed from a transparent material rather than be formed from a light diffusion material. For example, the housing 551 may be a transparent cylindrical housing (e.g., transparent plastic sleeve or cover). However, the muzzle flash emulator assembly 550*a* may have both the diffusion member 559 and a housing 551 formed from a light diffusing material.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains," "containing," "includes," "including," "comprises," and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, and the like are used in relation to the illustrative embodiments as they are depicted in the figures, the upward direction being toward the top of the corresponding figure and the downward direction being toward the bottom of the corresponding figure.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A weapon emulator, comprising:

a frame;

a trigger and a barrel coupled to the frame;

a power source coupled to the frame;

a muzzle flash emulator attachment that is coupled to a first end of the barrel, the muzzle flash emulator attachment including:

a body having a first end coupled to the first end of the barrel, a second end, an inner surface, an outer surface opposite the inner surface extending from the first end to the second end, and defining a plurality of slots extending from the inner surface to the outer surface positioned between the first and second ends;

a cover disposed in the body; and a light source at least partially disposed in the cover; and a circuit coupled to the light source and including a power source and a switch, the switch being transitionable from an open state to a closed state to turn on the light source to emit a light through the plurality of slots in response to pulling the trigger.

2. The weapon emulator of claim 1, wherein the muzzle flash emulator attachment includes the switch and the switch is transitionable from the open state to the closed state in response to a gas released into the barrel in response to pulling the trigger.

3. The weapon emulator of claim 2, wherein the switch comprises:

a first contact disposed in the body that is connected to the light source;

a second contact disposed in the body that is connected to the power source;

a switch member including an electrode moveable from the open state where the electrode is separated from the first and second electrodes to the closed state where the electrode is engaged with the first and second contacts; and a biasing member disposed in the body and configured to bias the member toward the open state.

4. The weapon emulator of claim 1, wherein the switch includes a button coupled to the frame and positioned behind the trigger, wherein pulling the trigger depresses the button to transition the switch from the open state to the closed state.

5. The weapon emulator of claim 4, wherein the button at least partially extends into a trigger well configured to receive a finger and positioned exterior of the frame, wherein the trigger well is defined by the frame and a trigger guard coupled to the frame.

6. The weapon emulator of claim 1, wherein the light source is a light emitting diode.

7. The weapon emulator of claim 1, further comprising a member coupled to the frame and moveable relative to the barrel to strike the switch to transition the switch from the open state to the closed state in response to pulling the trigger.

8. The weapon emulator of claim 7, wherein the member is a bolt.

9. The weapon emulator of claim 1, wherein the body includes a first portion having a first cavity containing the light source and the cover and a second portion having a second cavity separated from the first cavity by an inner wall of the body, wherein the plurality of slots lead to the first cavity.

10. The weapon emulator of claim 9, wherein the barrel is received in the second cavity.

11. The weapon emulator of claim 9, wherein the switch comprises:

a first contact disposed in the body that is connected to the light source;

a second contact disposed in the body that is connected to the power source;

a switch member disposed in the second cavity including an electrode moveable from the open state where the electrode is separated from the first and second electrodes to the closed state where the electrode is engaged with the first and second contacts; and a biasing member disposed in the second cavity and configured to bias the member toward the open state.

12. The weapon emulator of claim 9, further comprising at least one vent formed in the inner wall connecting the first and second cavities.

13. The weapon emulator of claim 1, wherein the cover is formed from a light diffusion material.

14. The weapon emulator of claim 13, wherein the light diffusion material is either a frosted plastic or etched plastic.

15. The weapon emulator of claim 9, wherein the barrel is received in the second cavity.

* * * * *